US007040672B1

(12) United States Patent
Runge et al.

(10) Patent No.: US 7,040,672 B1
(45) Date of Patent: May 9, 2006

(54) BOLT LOCK, IN PARTICULAR A BOLT LOCK FOR CONTROL-CABINET DOORS

(75) Inventors: Friedhelm Runge, Wuppertal (DE); Manfred Sauerland, Essen (DE); Dirk Beckmannshagen, Wuppertal (DE)

(73) Assignee: EMKA Beschlagteile GmbH & Co. KG, (DE)

( * ) Notice: Subject to any disclaimer, the term of this patent is extended or adjusted under 35 U.S.C. 154(b) by 0 days.

(21) Appl. No.: 08/313,285

(22) PCT Filed: Mar. 30, 1993

(86) PCT No.: PCT/DE93/00314

§ 371 (c)(1),
(2), (4) Date: Feb. 17, 1995

(87) PCT Pub. No.: WO93/20315

PCT Pub. Date: Oct. 14, 1993

(30) Foreign Application Priority Data

Mar. 31, 1992 (DE) ..... 42 10 586

(51) Int. Cl.
*E05C 1/04* (2006.01)

(52) U.S. Cl. ..... 292/42; 292/2; 292/5; 292/41; 292/146; 292/DIG. 51; 292/DIG. 55; 292/DIG. 68

(58) Field of Classification Search ..... 292/2, 292/5, 32, 41, 42, 146, 183, 189, DIG. 51, 292/DIG. 55, DIG. 68, 145, 157, 161, 162; 27/1

See application file for complete search history.

(56) References Cited

U.S. PATENT DOCUMENTS

| | | | | |
|---|---|---|---|---|
| 978,963 A | | 12/1910 | Vance | |
| 1,438,547 A | * | 12/1922 | O'Connor | 292/DIG. 68 X |
| 1,531,321 A | * | 3/1925 | Vance | 292/DIG. 68 X |
| 2,527,933 A | * | 10/1950 | Jakeway | 217/60 E |

(Continued)

FOREIGN PATENT DOCUMENTS

| | | |
|---|---|---|
| DE | 1559707 | 10/1969 |

(Continued)

*Primary Examiner*—Brian E. Glessner
*Assistant Examiner*—Carlos Lugo
(74) *Attorney, Agent, or Firm*—Robert W. Becker & Associates; Robert W. Becker

(57) ABSTRACT

A bolt lock, especially for control-cabinet doors or similar doors or flaps. The lock comprises a flat-bar bolt that is mounted to move parallel to the edge of the door, preferably within the arc of swing of the door. Disposed on the flat-bar bolt is at least one locking section. A bolt holder is mounted on the frame of the door to receive and hold the locking section. An actuator is provided for longitudinal displacement of the flat-bar bolt between an unlocked and a locked position. To provide a more secure lock that cannot become stuck, there is provided that to form the locking section, at least a portion of a length of the flat-bar bolt is twisted about a longitudinal axis of the bolt such that the twisted portion is disposed at an angle to an orientation of the bolt and provides a locking surface. The bolt holder is provided with a catch that is disposed at the same angle relative to the bolt as is the locking surface, with the catch being adapted to engage over the locking surface.

9 Claims, 2 Drawing Sheets

U.S. PATENT DOCUMENTS

| | | | | | |
|---|---|---|---|---|---|
| 2,715,746 | A | * | 8/1955 | Travis | 16/85 |
| 2,784,992 | A | * | 3/1957 | Karjala et al. | 292/162 |
| 5,039,143 | A | * | 8/1991 | Ramsauer | 292/39 |
| 5,201,557 | A | * | 4/1993 | Schlack | 292/161 |
| 5,219,191 | A | * | 6/1993 | Wolter | 292/157 |
| 5,887,915 | A | * | 3/1999 | Ramsauer | 292/160 |

FOREIGN PATENT DOCUMENTS

| | | | | |
|---|---|---|---|---|
| EP | 0261268 | | 3/1988 | |
| FR | 981011 | | 2/1949 | |
| FR | 1198173 | | 6/1958 | |
| GB | 2259940 | * | 3/1993 | 292/42 |

* cited by examiner

BOLT LOCK, IN PARTICULAR A BOLT LOCK FOR CONTROL-CABINET DOORS

BACKGROUND OF THE INVENTION

The invention relates to a bolt lock, especially for control-cabinet doors or similar doors or flaps, and comprises a flat-bar bolt that is mounted to move parallel to the edge of the door, preferably within the arc of swing of the door, the flat-bar bolt having disposed thereon at least one locking section, the lock further comprising a bolt holder mounted on the door frame to receive and hold the locking section, and also comprising an actuating means for the longitudinal displacement of the flat-bar bolt between an unlocked and a locked position.

A bolt lock of this general type is described in EP 0 261 268 B1, where the bar, which is made of flat strip material, is guided between the legs of an otherwise U-shaped bolt holder that is mounted on the door frame via its U-profile crosspiece, with both sides of the bar carrying respectively projecting locking pins; the U-legs of the bolt holder have portions that open in one of the axial directions of the bar and in which the locking pins carried by the bar engage during longitudinal displacement of the bar, so that the bar is appropriately locked in the bolt holder.

This known configuration has the drawback that the bar with the locking pins and the bolt holder with the associated cutout sections must be precisely aligned with one another in order to ensure that when the bar is displaced longitudinally, the locking pins engage in the cutout sections of the bolt holder without getting stuck. During transport and set up, especially of sheet metal cabinets, warping of the parts of the sheet metal cabinet and of the door frame as a carrier for the bolt holder and of the door arrangement as carrier for the flat-bar bolt can occur, so that the necessary precision of fit of the positions of the components relative to one another is no longer ensured.

SUMMARY OF THE INVENTION

It is therefore an object of the present invention to improve a bolt lock of the aforementioned general type in such a way that a reliable locking action of the bolt lock without sticking results.

In a first embodiment, the invention provides that to form the locking section, at least a portion of the length of the flat-bar bolt is twisted about a longitudinal axis of the bolt such that the twisted locking section of the flat strip profile is disposed at an angle to the orientation of the flat-bar bolt and provides a locking surface over which engages a catch of said bolt holder that is disposed at the same angle relative to the flat-bar bolt.

Due to the twisting of the flat strip profile of the flat-bar bolt, a curved transition is provided between the portions of the flat strip profile of the flat-bar bolt; during longitudinal displacement of the flat-bar bolt, this allows the locking surface formed on the twisted locking section to shift such that it constantly approaches below the catch of the bolt holder. Thus, this arrangement is to a large extent independent of imprecision in the alignment of the components relative to one another, because due to the progressive transition between the unlocked and the locked positions of the flat-bar bolt, there is no possibility for the bolt to get stuck; rather, a correction of the orientation of the components relative to one another occurs during the locking process via the smooth engagement behind the catch of the bolt holder by means of the fact that the locking surface, via a twist region, gradually slides under the catch of the bolt holder.

Pursuant to one preferred specific embodiment of the present invention, the locking section of the flat-bar bolt is twisted by 90 degrees, so that the locking surface of the flat-bar bolt is disposed at right angles to the orientation of the remainder of the flat-bar bolt.

The bolt holder preferably has a U-shaped cross-sectional configuration, with one of the two flanges of the U-shaped cross section having a lug that is directed toward the other flange and that forms the catch that engages over the locking surface of the flat-bar bolt, with the crosspiece of the U-shaped bolt holder serving for mounting thereof.

In this way, in an expedient manner, the bolt holder, on that side across from the catch, can be provided with a guide abutment for the associated narrow side of the locking section of the flat-bar bolt, because in this way there is provided a guidance of the flat-bar bolt via its locking section in the bolt holder such that there is ensured that the twisted locking surface of the flat-bar bolt will pass beneath the catch of the bolt holder. To improve this guidance of the locking section of the flat-bar bolt, the guide abutment has approach or contact surfaces that are respectively curved in the direction of displacement of the flat-bar bolt.

To ensure an alignment of the locking section to the catch that will guarantee a subsequent locking during introduction of the flat-bar bolt into the bolt holder when the door is closed, an outer side of the catch is provided with a beveling that is inclined relative to the introduction opening for the flat-bar bolt into the bolt holder; in addition, the inner corner region between the crosspiece and the flange of the bolt holder that is disposed across from the catch is provided with an inclined surface so that when the flat-bar bolt enters the bolt holder in other than an exact fit, the flat-bar bolt is first automatically aligned at the outer beveling of the catch and then at the inner inclined surface between the flange and the crosspiece of the bolt holder.

In a second specific embodiment of the present invention, to form the locking section at least a portion of a length of the flat-bar bolt is twisted about a longitudinal axis of the bolt such that the twisted locking section of the flat strip profile is disposed at an angle to the orientation of the flat-bar bolt, whereby the twisted locking section is additionally angled off and is provided with a hook-shaped tang as a punched out component that in the locking position catches behind a crosspiece of the bolt holder that extends at right angles to the displacement plane of the flat-bar bolt. In this way, the bolt no longer passes through the bolt holder, but rather, due to the angled-off portion in the locking section, is disposed beyond the bolt holder with only the hook-shaped tang extending into the plane of the bolt holder in order to catch behind the appropriately disposed crosspiece. In this way, further tolerances in the position of the flat-bar bolt relative to the bolt holder cause no problems.

Although a flat-bar bolt as part of a bolt lock with an angled-off portion that engages over a bolt holder is disclosed in U.S. Pat. No. 9,789,63, in that patent a respective locking nose was stamped out of the broad side of the flat-bar bolt and extended into the angled-off portion or into the bolt holder.

The hook-shaped tang is preferably punched out with an inclination relative to the plane of the angled-off portion of the flat-bar bolt, so that an inclined approach or contact surface results to catch behind the crosspiece of the bolt holder; in this way, there is ensured in an advantageous manner that a larger introduction region results for the crosspiece of the bolt holder, whereby at the same time a "drawing in" of the lock mechanism is effected during the locking movement of the flat-bar bolt.

Pursuant to one preferred specific embodiment of the present invention, the bolt holder is embodied as a U-shaped component, with the crosspiece extending between the U-legs and being disposed at right angles to the plane of displacement of the flat-bar bolt.

BRIEF DESCRIPTION OF THE DRAWINGS

Specific embodiments of the invention are shown in the drawings and are subsequently described in detail. Shown are.

DESCRIPTION OF PREFERRED EMBODIMENTS

The drawings illustrate only the cooperation of the bolt holder and the flat-bar bolt, since the arrangement of the bolt lock in the frame of a sheet metal cabinet having a sheet metal cabinet door, as well as the function and actuation thereof, are sufficiently described in the aforementioned state of the art of EP 0 261 268 B1.

Figure 1:
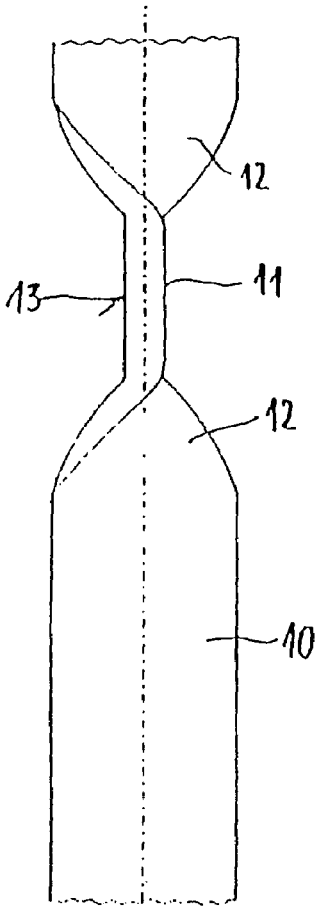
FIG. 1 a view of a flat-bar bolt with a locking section.

As shown in detail in FIG. 1, the flat-bar bolt 10 has a locking section 11 that is twisted by 90 degrees about the longitudinal axis of the flat-bar bolt 10 relative to the rectangular shape of the flat bar, whereby adjoining the two ends of the locking section 11 is a respective region 12 via which the surface of the flat-bar bolt 10 turns smoothly into its twisted position in the locking section 11.

Figure 3:
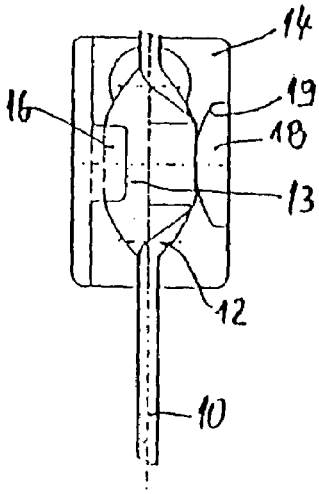
FIG. 3 a side view of the subject matter of FIG. 2.

As can be seen in particular from FIG. 3, the locking section 11 of the flat-bar bolt 10 forms a locking surface 13 that is twisted by 90 degrees relative to the surface of the flat-bar bolt 10. The associated bolt holder 14 has an essentially U-shaped cross-sectional configuration with side flanges 30, 31 (FIG. 4), the crosspiece 15 of which can be secured to a non-illustrated door via a projecting portion 17 or an associated securing means. The flange 30 of the U-shaped bolt holder 14 has a lug that extends in the direction toward the other flange 31 and forms a catch 16 for extending over the locking surface 13 of the twisted locking section 11 of the flat-bar bolt 10. Formed on the other flange 31, across from the catch 16, is a guide abutment 18 that has an abutment surface 19 that is curved in the direction of displacement of the flat-bar bolt 10.

Figure 4A:
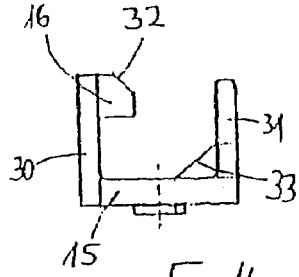
FIG. 4*a* a modification of the subject matter of FIG. 4.
Figure 2:
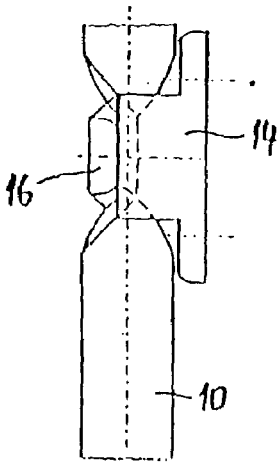
FIG. 2 the flat-bar bolt of FIG. 1 with the pertaining bolt holder.
Figure 4:
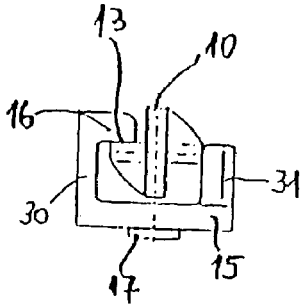
FIG. 4 a view from below of the subject matter of FIG. 3.

In FIG. 4*a*, which is a modification of the bolt holder 14 that is shown in FIG. 4 and was previously described, the outer, upper side of the catch 16 is provided with a beveling 32 that is inclined relative to the introduction opening for the flat-bar bolt 10 into the bolt holder 14 and hence relative to the oppositely disposed flange 31; in addition, the inner corner region between the crosspiece 15 and the flange 31 of the bolt holder 14 has an inwardly disposed inclined surface 33. The structures 32, 33 ensure that when the flat-bar bolt 10 enters the bolt holder 14, a guidance and straight alignment of the flat-bar bolt 10 relative to the flanges 30, 31 of the bolt holder 14 is effected, so that when the flat-bar bolt 10 is displaced longitudinally, the locking section 11 thereof will reliably extend below the catch 16. In this connection, when the door is closed, the flat-bar bolt 10, which extends perpendicular to the crosspiece 15 of the bolt holder 14, is first guided by the beveling 32 into the introduction opening, and if it enters somewhat crookedly is then straightened out at the inclined surface 33 in the bolt holder 14.

As can be readily seen from the illustrations of FIGS. 1 to 4, in the non locked position the flat-bar bolt 10 extends through the bolt holder 14, with the surface of the flat-bar bolt extending perpendicular to the orientation of the catch 16 and the locking section 11 being disposed beyond the bolt holder 14. If to effect a locking the flat-bar bolt is longitudinally displaced, the twisted locking section 11 slides into the bolt holder 14, whereby in the end position of locking the locking surface 13 formed on the twisted locking section has the catch 16 of the bolt holder 14 extending thereover. Thus, due to the continuous twist region 12, during insertion there is effected a gradual engagement of the locking section 11 into the bolt holder 14, whereby the guide abutment 18 that is disposed across from the catch 16 prevents a deflection of the flat-bar bolt 10, i.e. of the locking section 11 thereof. Due to the smooth and linear introduction of the locking section 11 into the bolt holder 14, a secure locking is achieved even with existing tolerances and ensures an adequately secure locking in the end position.

Figure 5:
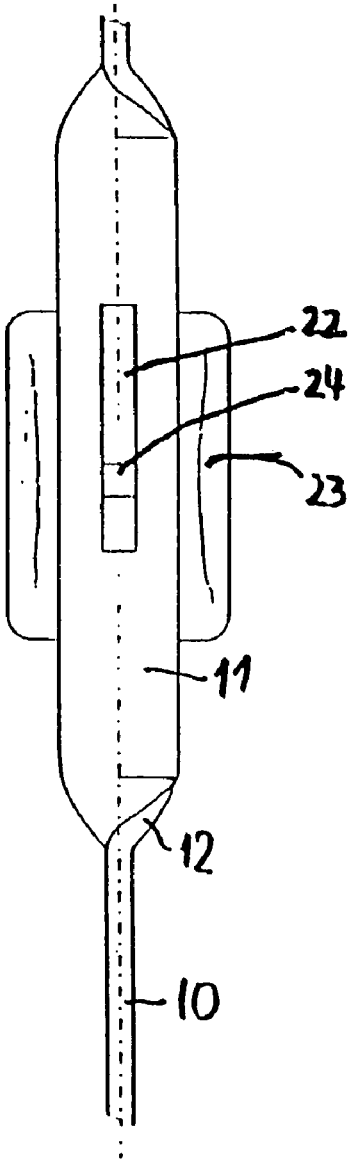
FIG. 5 a front view of another exemplary embodiment of the flat-bar bolt and bolt holder, FIG. 6 a side view of the subject matter of FIG. 5.
Figure 6:
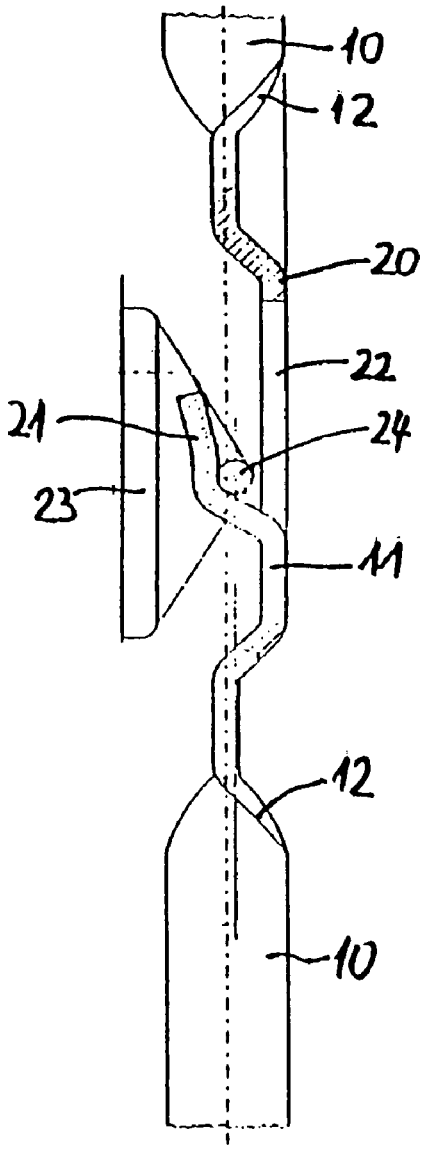

The specific embodiment illustrated in FIGS. 5 and 6 deviates from the previously described embodiment of FIGS. 1 to 4 in that the locking section 11 of the flat-bar bolt 10 is no longer disposed in the plane of the bolt holder 14, but rather is offset out of the plane of the bolt holder 14 via an angled piece 20. In the region of the angled piece 20, a hook-shaped tang 21 is punched out of the locking section 11 in a direction toward the bolt holder 14 accompanied by the formation of an opening 22; in the locking position (FIG. 6) of the bolt lock, the tang extends behind a crosspiece 24 that is carried by the U-legs of the otherwise U-shaped bolt holder 23. The tang 21 is thus punched out at an inclination relative to the plane of the angled portion of the flat-bar bolt, so that an inclined approach or contact surface results for the engagement or catching of the crosspiece 24 of the bolt holder 23. In other respects, this embodiment provides the same function as was described in conjunction with the embodiment of FIGS. 1 to 4.

The present invention is, of course, in no way restricted to the specific disclosure of the specification and drawings, but also encompasses any modifications within the scope of the appended claims.

What we claim is:

1. In a bolt lock for doors and flaps and comprising a flat-bar bolt that is mounted to move parallel to an edge of a door and that has disposed thereon at least one locking section, and further comprising a bolt holder mounted on a frame of said door to receive and hold said locking section, and also comprising an actuating means for longitudinal displacement of said flat-bar bolt between an unlocked and a locked position, the improvement wherein:

said locking section comprises at least one twisted portion with respect to a longitudinal axis of said flat bar bolt such that said twisted portion is disposed at an angle to an orientation of said flat-bar bolt and provides a locking surface; and said bolt holder is provided with a catch that is disposed at the same angle relative to said flat-bar bolt as is said locking surface of said locking section, said catch being adapted to engage over said locking surface.

2. A bolt lock according to claim 1, wherein said locking section of said flat-bar bolt is twisted by 90°, so that said locking surface of said locking section of said flat-bar bolt is disposed at right angles to said orientation of said flat-bar bolt.

3. A bolt lock according to claim 2, wherein said bolt holder has a U-shaped cross-sectional configuration, including side flanges that are connected by a crosspiece that serves for mounting of said bolt holder, and wherein one of said flanges is provided with a lug that faces in the direction of the other of said flanges and that forms said catch for engaging over said locking surface of said locking section of said flat-bar bolt.

4. A bolt lock according to claim 3, wherein said bolt holder, on a side opposite said catch, is provided with a guide abutment for an associated narrow side of said locking section of said flat-bar bolt.

5. A bolt lock according to claim 4, wherein said guide abutment of said bolt holder is provided with abutment surfaces that are curved in a direction of displacement of said flat-bar bolt.

6. A bolt lock according to claim 3, wherein an outer side of said catch, remote from said crosspiece, is provided with a beveling that is inclined relative to the oppositely disposed one of said flanges, and wherein an inner corner region of said bolt holder between said crosspiece and said flange across from said catch is provided with an inclined surface that spans said corner region.

7. In a bolt lock for doors and flaps and comprising a flat-bar bolt that is mounted to move parallel to an edge of a door and that has disposed thereon at least one locking section, and further comprising a bolt holder mounted on a frame of said door to receive and hold said locking section, and also comprising an actuating means for longitudinal displacement of said flat-bar bolt between an unlocked and a locked position, the improvement wherein:

said locking section comprises at least one twisted portion with respect to a longitudinal axis of said flat bar bolt such that said twisted portion is disposed at an angle to an orientation of said flat-bar bolt, whereby said twisted locking section has an angled-off piece in which is provided as a punched-out component a hook-shaped tang that projects from said angled-off piece; and said bolt holder has a member that extends at right angles to said orientation of said flat-bar bolt, whereby in said locked position of said flat-bar bolt, said tang catches behind said member of said bolt holder.

8. A bolt lock according to claim 7, wherein said hook-shaped tang is punched out with an inclination relative to a plane of said angled-off piece, thus providing an inclined contact and approach surface for catching behind said member of said bolt holder.

9. A bolt lock according to claim 7, wherein said bolt holder is embodied as a U-shaped component having U-legs between which is held said member in the form of a crosspiece, and wherein said bolt holder is disposed at right angles to said orientation of said flat-bar bolt.

* * * * *